United States Patent [19]

Anseel et al.

[11] Patent Number: 4,739,947

[45] Date of Patent: Apr. 26, 1988

[54] CONICAL COILING OF WIRE ON A SPOOL WITH AT LEAST ONE CONICALLY FORMED FLANGE

[75] Inventors: Freddy Anseel, Kortrijk-Marke; Pierre Cosaert, Kortrijk, both of Belgium

[73] Assignee: N.V. Bekaert S.A., Zwevegem, Belgium

[21] Appl. No.: 27,884

[22] Filed: Mar. 19, 1987

[30] Foreign Application Priority Data

Apr. 9, 1986 [NL] Netherlands ..... 8600896

[51] Int. Cl.[4] ..... B65H 55/04

[52] U.S. Cl. ..... 242/176; 242/18 R; 242/47; 242/26.1; 242/118.4; 242/158 R; 242/174

[58] Field of Search ..... 242/175, 176, 159, 174, 242/170, 16, 17, 25 R, 18 R, 47, 54 R, 26.1, 26.4, 26, 118.4, 158 R, 158.2, 158.4 R, 128, 129

[56] References Cited

U.S. PATENT DOCUMENTS

| | | | |
|---|---|---|---|
| 3,021,092 | 2/1962 | Whearley | 242/128 |
| 3,218,004 | 11/1965 | Meeske et al. | 242/158.2 |
| 3,632,061 | 1/1972 | Roseboom | 242/129 |
| 4,253,298 | 3/1981 | Varga | 57/13 |
| 4,580,399 | 4/1986 | Henrich | 57/59 |

FOREIGN PATENT DOCUMENTS

| | | |
|---|---|---|
| 686697 | 1/1940 | Fed. Rep. of Germany . |
| 852677 | 10/1960 | United Kingdom . |

*Primary Examiner*—Stanley N. Gilreath

*Attorney, Agent, or Firm*—Shlesinger, Arkwright & Garvey

[57] ABSTRACT

The invention relates to a method whereby wire is coiled conically on to a spool. The spool has at least one conically formed flange. The number of windings per layer is gradually increased during the coiling operation.

12 Claims, 3 Drawing Sheets

CONICAL COILING OF WIRE ON A SPOOL WITH AT LEAST ONE CONICALLY FORMED FLANGE

The invention relates to a method of coiling wire on a spool having a cylindrical core, whereby the wire is wound in layers and each layer comprises a number of adjacent windings and whereby, on completion of each layer the direction of layer formation is reversed and the coiling operation continues until the desired amount of wire is wound on the spool, whereby the wire is coiled conically on the spool with cylindrical core by starting of a first layer with a minimum number of windings, after which the coiling operation proceeds so that for at least part of the coiling operation, the number of windings per layer is gradually increased.

A method of conical coiling on a spool with a cylindrical core and with two straight flanges mounted perpendicularly to the cylindrical core is well known from the U.S. Pat. No. 3,218,004.

In a known method the coiling operation on a cylindrical core starts at the lower flange with a minimum number of windings. After the formation of the first layer with a minimum number of windings, the direction of layer formation is reversed to form a second layer of windings. The second layer is formed until the last winding touches the lower flange, after which the direction of the layer formation is then again reversed to form a third layer of windings.

In this way, the wire is wound into a conical coil on a cylindrical core, whereby the adjacent windings support each other in such a way as to substantially prevent their slipping over each other and sliding down the core.

Such a spool consisting of a cylindrical core and two straight flanges mounted perpendicularly to this cylindrical core, with conically wound wire thereon, has the disadvantage that, during the uncoiling operation or the drawing of the wire from the spool, particularly for the windings near to the flanges, the wire is subjected to high tensions and friction, which can lead to wire rupture.

The object of the present invention is to provide a method, whereby the above-mentioned disadvantage is eliminated.

To obtain this object, the invention provides for the method whereby the wire is coiled on a spool with a cylindrical core, which is provided with a straight lower flange mounted perpendicularly on the cylindrical core and with a conically formed upper flange, whereby the number of windings per layer is gradually increased throughout the whole coiling operation, and whereby the amount of the increase in the number of windings in each successive layer, after the completion of a first conical section extending over the whole length of the cylindrical core, is determined as a function of the conicity of the uper flange.

By using a spool with a conical upper flange, another advantage is obtained, that a substantially greater volume of wire can be wound on the same core, which obviously leads to an important saving in the number of cores required.

In the method according to the invention, a first conical section is formed, this section extending over the whole length of the cylindrical core, whereby the shape and the volume of the first conical section are determined by the location of the turning points in the layer formation method and of course also by the type of the wire used. After the completion of the formation of the first conical section and therefore of the last layer of windings which constitutes the outer boundary of the first conical section which extends between the top of the cylindrical core and lower flange; the winding operation is continued, whereby the number of windings per layer continues to increase in each successive layer. The amount of the increase in the number of windings per layer is in this case a function of the conicity of the upper flange used. With a high degree of conicity i.e. a small angle taper, the difference in the number of windings or convolutions per layer will be greater than with a conical flange with a large angle taper.

The invention also relates to a method, whereby the wire is coiled conically on a spool with a cylindrical core provided with a conically formed lower flange and with a conically formed upper flange, whereby the number of windings per layer is increased gradually during the whole coiling operation.

The invention further relates to a spool with conically wound wire thereon, whereby this spool is provided with at least one conical flange.

The invention will now be illustrated with reference to the drawing, wherein.

Figure 1:
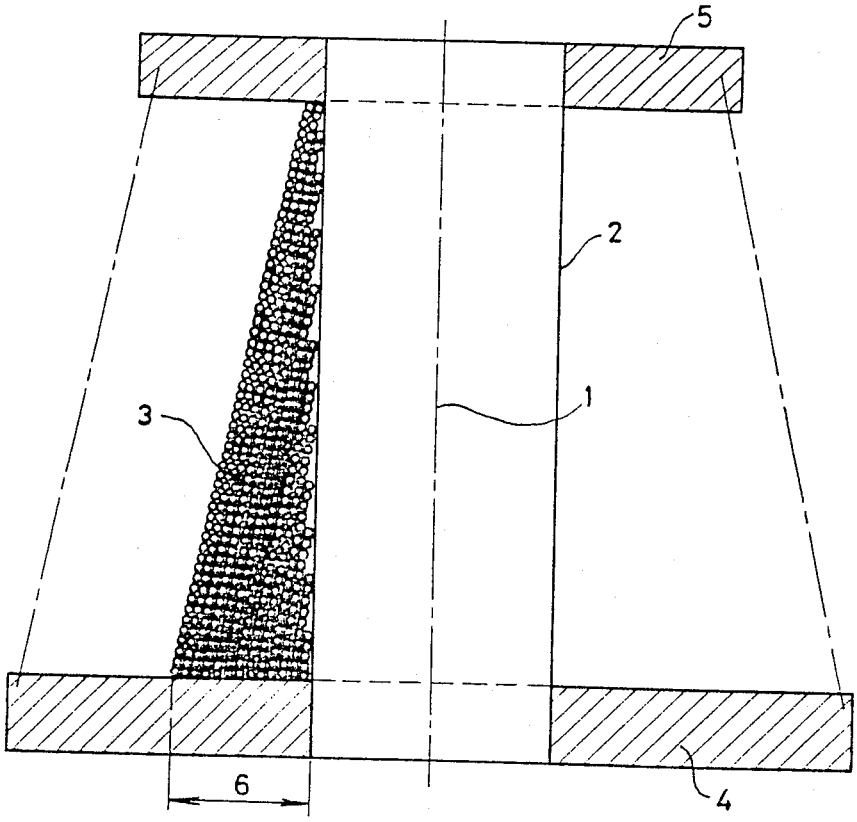
FIG. 1 shows a cross-section of a spool consisting of a cylindrical core and two straight flanges mounted perpendicularly to this core with conically coiled wire on this spool according to the prior art.

In FIG. 1 the spool 1 has a cylindrical core 2, a lower flange 4 and an upper flange 5. Both lower and upper flanges are straight and mounted perpendicularly to the cylindrical core 2. Such a spool is known from the U.S. Pat. No. 3,218,004. In conical coiling, coiling commences or starts against the straight lower flange and a first layer comprising a minimum number of windings will be formed, after which, or if desired after a brief continuation of the coiling operation at increased pitch or not, in the upward direction; the direction of layer formation is reversed, so that a layer is then formed in the direction of the lower flange. When this layer reaches the lower flange, the direction of layer formation is again reversed and coiling continues to form a third layer until the last convolution or winding of the third layer is wound directly on to the cylinder core, after which, or if desired after a brief continuation of coiling at increased pitch, the direction of layer formation is again reversed, etc. Coiling in this manner is continued until a first conical section 3 has been formed, whereby the outer boundary is constituted by the layer of windings which extends from the intersection between the cylindrical core and the straight upper flange to the point at which the last convolution at the other extremity of the same layer meets the lower flange. The greatest thickness 6 of the first conical section is important in the determination of the dimension of the lower flange 4 with respect to the dimension of the upper flange 5. The outside diameter of the two flanges differs by an amount equal to at least twice the dimension of the said part 6 of the first conical section. After formation of the first conical section, coiling continues, whereby the number of windings per layer remains constant and equal to the number of windings in the outer layer of the above described first conical section. The full spool coiled according to this method offers excellent stability of the wire coil; the end of the wire at the last convolution can be fastened in a simple manner so that the spool and coil can be handled without difficulty.

Figure 2:
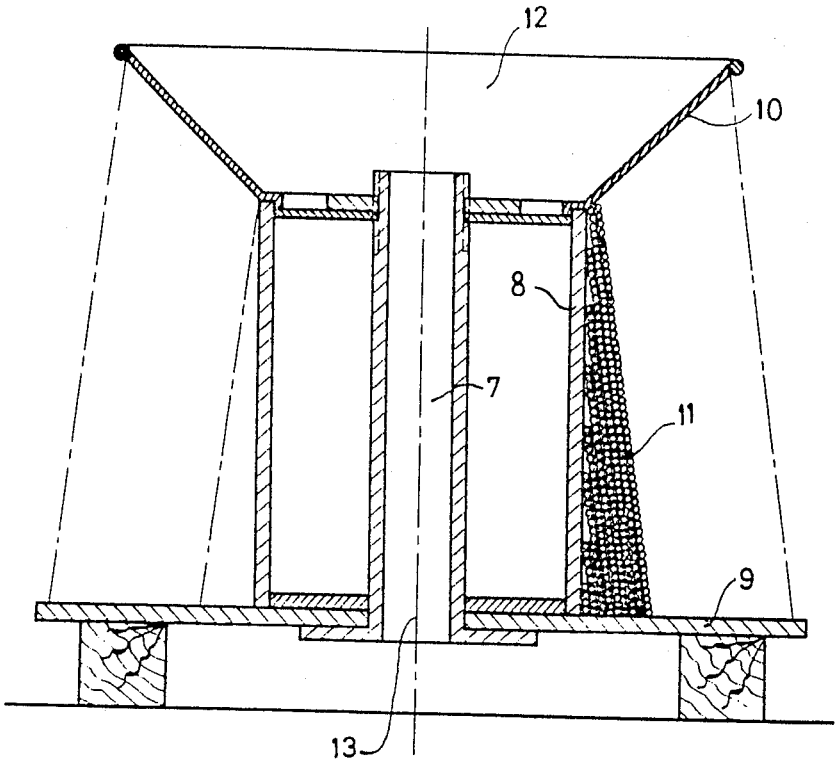
FIG. 2 shows a cross-section of a spool consisting of a cylindrical core, a straight lower flange and a conical upper flange with conically coiled wire on this spool.

FIG. 2 shows a spool 7 with a cylindrical core 8 provided with a straight lower flange 9 and with a conically tapered upper flange 10 or with at least one conical flange. The axis 13 of the cylindrical part and the axis 12 of the conical upper flange 10 coincide. In the coiling operation according to the method of the invention, the wire is now coiled or wound on such a spool provided with at least one conical flange 10. The method for coiling wire on such a spool again comprises first the formation of a first conical section 11 which extends over the whole length of the cylindrical core 8. After the completion of the first conical section 11, whereby each successive layer comprises a greater number of windings than the previous layer; the winding operation is continued, and the increase in the number of convolutions or windings per layer from the point at which the conical upper flange 10 has been reached, is determined primarily by the conicity of the upper flange 10 used.

As a general rule, the increase in the number of windings between two successive layers after the point at which the conical upper flange 10 has been reached, will be relatively small; and mostly smaller than the increase in the number of windings between two successive layers during the formation of the first conical section 11.

Figure 3:
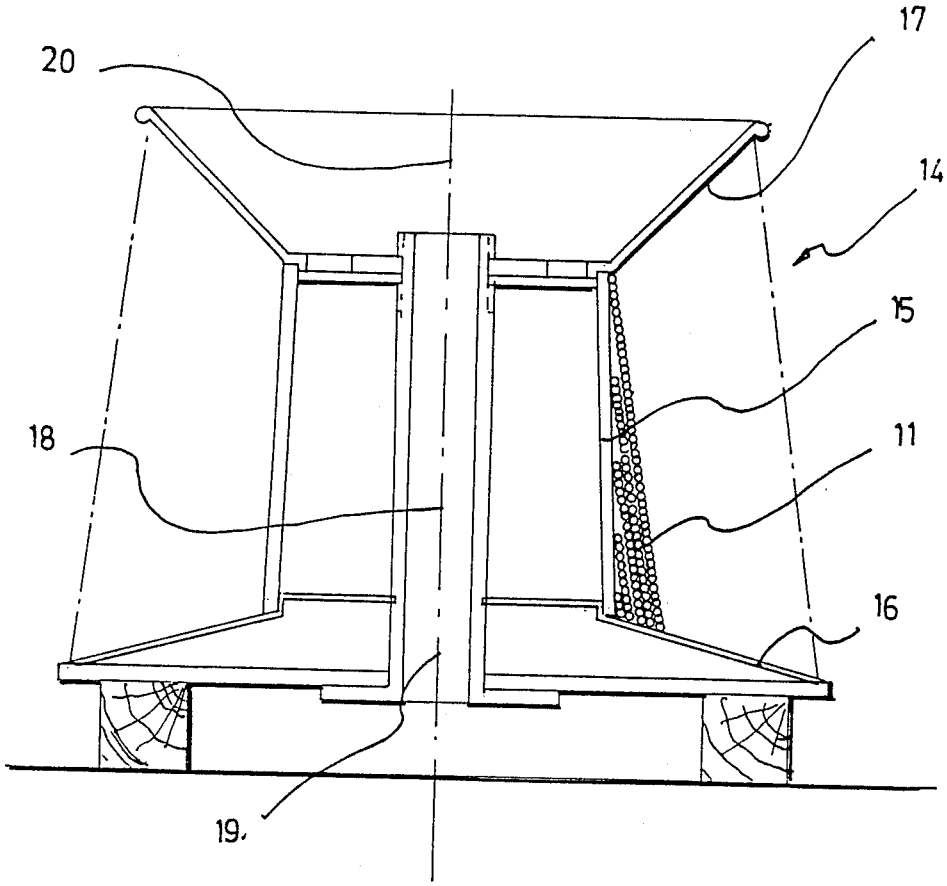
FIG. 3 shows a cross-section of a spool consisting of a slightly conical core, a conical lower flange and a conical upper flange with conically coiled wire on this spool.

FIG. 3 shows a spool 14 with a slightly conically formed core 15 provided with a less conically formed lower flange 16 and with a more conically formed upper flange 17. The core 15 has an axis 18 which coincides with the axis 19 of lower flange 16. The upper flange 17 has an axis 20 which also coincides with the axis 18. After the completion of the first conical section 11, whereby each successive layer comprises a greater number of windings than the previous layer; according to the invention, the coiling operation is continued, whereby the increase in the number of windings per layer from the point at which the conical upper flange 17 has been reached, is determined by the conicity of the upper flange 17 and the lower flange 16.

It is clear that in the method described in FIG. 2, whereby a spool 7 with a cylindrical core 8 and with at least one conical flange is used; it is also possible to use a spool 7 with a slightly tapered or slightly conical core 8. It is also possible to use in the method described in FIG. 3, a cylindrical core 15 instead of a slightly tapered core 15.

We claim:

1. A method of coiling wire, comprising the steps of:
(a) providing a spool having a core and flanges at opposite ends thereof, at least one of the flanges having a wire receiving surface extending frustoconically from the core;
(b) providing a length of wire;
(c) winding a first portion of the wire about the core by commencing at one of the flanges and extending toward the other flange, and thereby forming a first wire layer extending along the core a distance less than the distance separating the flanges;
(d) winding a second portion of the wire about the first layer and thereby forming a second wire layer terminating proximate the one flange;
(e) winding a third portion of the wire about the second layer, extending toward the other flange, and thereby forming a third wire layer, the third layer extending along the core a distance exceeding the distance the first layer extends along the core and thereby forming a conical section; and,
(f) continuing to wind the remaining wire about the conical section in an alternating sequence, each odd numbered layer extending along the core a distance exceeding the distance the immediately preceding odd numbered layer extends along the core until a layer extends from one flange to the other and thereafter continuing to wind the wire in layers about the section so that each layer extends from one flange to the other.

2. The method of claim 1, including the step of:
(a) providing a spool having a substantially cylindrical core.

3. The method of claim 1, including the step of:
(a) providing a spool having both flanges with wire receiving surfaces extending frustoconically from the core.

4. The method of claim 3, including the step of:
(a) providing a spool having a substantially cylindrical core.

5. The method of coiling wire onto a spool having a core and a pair of flanges at opposite ends thereof, at least one of the flanges having a wire receiving surface extending frustoconically from the core, comprising the steps of:
(a) providing a length of wire;
(b) forming a conical section on the spool comprising a plurality of wire layers overlayed one upon the other, the first layer extending along the core from one flange towards the other a distance less than the distance separating the flanges, a second layer extending toward the one flange and along the core a distance substantially equally to the distance the first layer extends along the core, and a third layer extending toward the other flange and along the core a distance exceeding the distance the first layer extends along the core; and,
(c) continuing to wind wire about the section in an alternating sequence so that each odd numbered layer extends along the core a distance exceeding that of the immediately preceding odd numbered layer until a wire layer extends from one flange to the other and thereafter winding the wire in layers extending between the flanges.

6. A coil of wire, comprising:
(a) a spool having a core with flanges at opposite ends thereof, at least one of said flanges having a wire receiving surface extending frustoconically from said core;
(b) a first portion of a length of wire is wound about said core into a conical section, said section comprising a plurality of wire layers overlayed one upon the other, the first layer thereof extending along the core from a first flange towards the second flange by a distance less than the distance separating said flanges, a second layer extends toward the first flange and along the core a distance substantially equal to the distance said first layer extends along said core and a third layer extends toward the second flange and along said core a distance exceeding the distance said first layer extends along said core and thereafter a plurality of layers are wound thereabout in an alternating sequence so that each odd numbered layer extends along said core a distance exceeding that of the immediately preceding odd numbered layer until a wire layer extends from one flange to the other; and, (c) the remaining portion of said wire is wound about said section in a plurality of layers extending between said flanges.

7. The coil of claim 6, wherein:

(a) each of said flanges has a wire receiving surface extending frustoconically from said core.

8. The coil of claim 6, wherein:

(a) said core is cylindrical.

9. The coil of claim 6, wherein:

(a) said core is frustoconical.

10. The coil of claim 6, wherein:

(a) the other of said flanges extends generally transverse to said core.

11. The coil of claim 7, wherein:

(a) said core is frustoconical.

12. The coil of claim 7, wherein:

(a) the wire receiving surface of one flange extends from said core by an angle which differs from the angle by which the other wire receiving surface extends from said core.

* * * * *